United States Patent [19]

Pogue

[11] Patent Number: 4,955,604

[45] Date of Patent: Sep. 11, 1990

[54] WEIGHT LIFTING RACK

[76] Inventor: David C. Pogue, 140 Lake Hills Dr., Oak Ridge, Tenn. 37830

[21] Appl. No.: 392,780

[22] Filed: Aug. 11, 1989

Related U.S. Application Data

[63] Continuation-in-part of Ser. No. 249,340, Sep. 26, 1988, abandoned.

[51] Int. Cl.[5] ..... A63B 21/072

[52] U.S. Cl. ..... 272/123; 272/117

[58] Field of Search ..... 272/62, 117, 118, 123, 272/134, 144, 93, DIG. 4; 248/304

[56] References Cited

U.S. PATENT DOCUMENTS

| | | | |
|---|---|---|---|
| 1,789,126 | 1/1931 | Aldeen | 248/304 X |
| 1,798,768 | 3/1931 | Vance | 248/304 |
| 3,118,668 | 1/1964 | Callahan . | |
| 3,948,512 | 4/1979 | Pfotenhauer . | |
| 4,201,380 | 5/1980 | Birch | 272/117 |
| 4,306,715 | 12/1981 | Sutherland | 272/117 |
| 4,360,198 | 11/1982 | Waulters | 272/117 |
| 4,368,884 | 1/1983 | Colvin | 272/123 |
| 4,420,154 | 12/1983 | Ramsey et al. | 272/118 |
| 4,441,706 | 4/1984 | Korzaniewski | 272/118 |
| 4,527,797 | 7/1985 | Slade, Jr. et al. | 272/123 |
| 4,540,171 | 9/1985 | Clark et al. | 272/118 |
| 4,564,194 | 1/1986 | Dawson | 272/123 |
| 4,666,150 | 5/1987 | Segrist et al. | 272/123 |
| 4,700,944 | 10/1987 | Sterba et al. | 272/117 |
| 4,729,561 | 3/1988 | Desjardins | 272/117 |
| 4,757,993 | 7/1988 | Rake | 272/134 X |
| 4,781,374 | 11/1988 | Lederman | 272/134 |

FOREIGN PATENT DOCUMENTS

| | | | |
|---|---|---|---|
| 2328486 | 5/1977 | France | 272/118 |
| 2010664 | 7/1979 | United Kingdom | 248/304 |

*Primary Examiner*—Robert W. Bahr

*Attorney, Agent, or Firm*—Pitts and Brittian

[57] ABSTRACT

A weight lifting rack (10) for supporting weights used in the performance of weight lifting exercises and for facilitating the safe performance of weight lifting exercises. The weight lifting rack (10) comprises a base (14) defining a platform for performing lifting exercises and a frame (12) mounted on and supported by the base (14). The frame includes first and second selectively spaced side portions (20 and 22) each of which is mounted on the base (14). The side portions (20 and 22) each includes a first vertical support member (26, 38) and a second vertical support member (28, 40), with each of the support members being provided with a plurality of holes (56) disposed along at least a portion of their lengths. The rack (10) further comprises at least one weight support hook (80) operatively associated with each side portion (20,22) of the frame (12) for releasably engaging and supporting the weights (16) and for catching such weights (16) should the lifter lose control of the weights or become tired.

4 Claims, 4 Drawing Sheets

WEIGHT LIFTING RACK

This invention is a Continuation-In-Part application of U.S. patent application Ser. No. 249,340 filed Sept. 26, 1988 now abandoned.

TECHNICAL FIELD

This invention relates to a weight lifting rack for supporting weights used in the performance of weight lifting exercises and for serving as spotting means during the performance of such exercises. The rack generally includes a frame mounted on a base, and a plurality of weight support hooks releasably secured to the frame.

BACKGROUND ART

It has long been recognized that weights used in performing weight lifting exercises can be dangerous if not maintained under control. Various weight racks have been devised for securing weights when not in use, but generally when exercise is performed with free weights, such as barbells or dumbbells, another individual, commonly known as a "spotter" must attend the lifter in order to assist the lifter should he lose control of the weights in order to avoid injury to the lifter or others nearby. However, this means that the lifter cannot safely exercise without someone present to serve as a spotter. Various devices have been designed to serve as spotting means during exercise, but these devices generally either provide insufficient control of the weights or unduly limit the range of motion of the weights during exercise. Examples of certain prior art devices are disclosed in U.S. Pat. Nos. 3,118,668; 3,948,513; 4,201,380; 4,205,838; 4,306,715; 4,360,198; 4,368,884; 4,420,154; 4,441,706; 4,540,171; 4,527,797; 4,564,194; 4,666,150; 4,757,993; and 4,781,374.

Therefore, it is an object of the present invention to provide a weight lifting rack for supporting weights used in the performance of weight lifting exercises.

It is a further object of the present invention to provide a weight lifting rack for supporting weights which serves as a spotting means during the performance of lifting exercises.

It is yet another object of the present invention to provide a weight lifting rack which can be readily disassembled and assembled to facilitate storage and transport.

Still another object of the present invention is to provide a weight lifting rack which is strong and durable, and is inexpensive to manufacture.

DISCLOSURE OF THE INVENTION

Other objects and advantages will be accomplished by the present invention which provides a weight lifting rack for supporting weights and for facilitating the safe performance of weight lifting exercises. The weight lifting rack comprises a base defining a platform for performing lifting exercises and a frame mounted on, and supported by, the base. The frame includes first and second selectively spaced side portions, each of which is mounted on the base. The side portions include first and second selectively spaced vertical support members which are each provided with a plurality of holes disposed along at least a portion of their lengths. The rack also comprises at least a pair of weight support pins which are slidably received in the holes of the vertical support members such that at least one pin extends between, and is supported by, the first and second vertical support members of each of the side portions of the rack in order to engage and support weights used in exercises and for catching such weights should the lifter lose control of the weights or become tired.

In an alternate embodiment of the rack of the present invention each of the side portions is provided with at least one weight support hook which is releasably secured in one of the holes provided in one of the vertical support members, the hooks serving the engage and support weights used in exercise.

BRIEF DESCRIPTION OF THE DRAWINGS

The above-mentioned features of the present invention will become more clearly understood from the following detailed description of the invention when read together with the drawings in which.

BEST MODE FOR CARRYING OUT THE INVENTION

Figure 1:
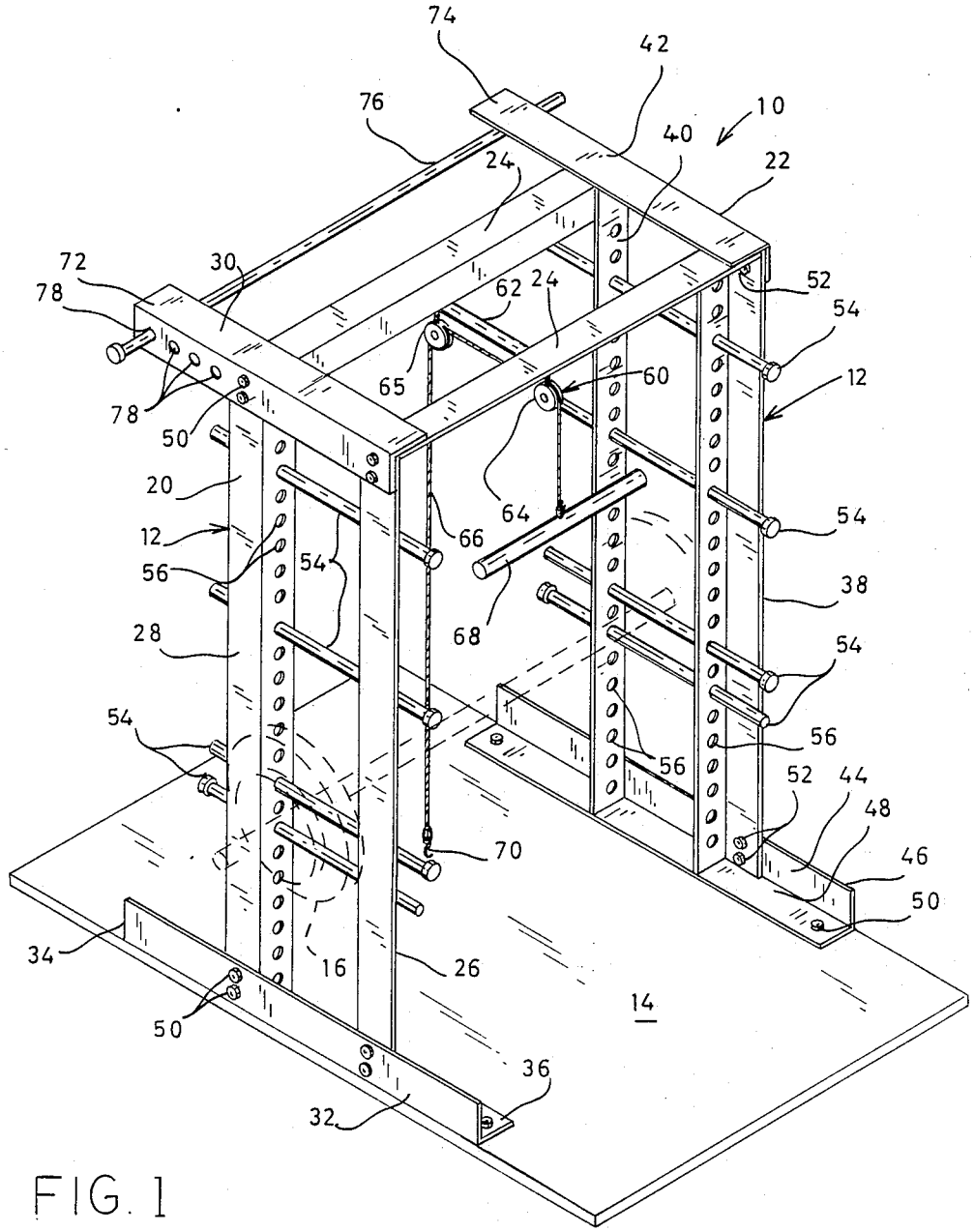
FIG. 1 illustrates a perspective view of a weight lifting rack of the present invention.
Figure 3:
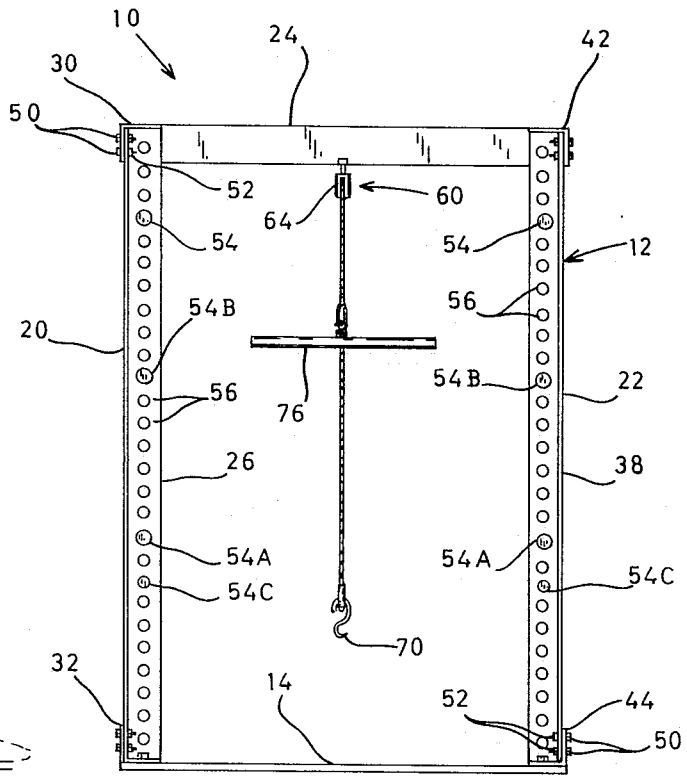
FIG. 3 illustrates an end view of a weight lifting device of the present invention.

A weight lifting rack incorporating various features of the present invention is illustrated at 10 in the figures. The rack 10 comprises a frame 12 supported on a base 14. As discussed in detail below, the frame 12 is designed to support weights, such as the illustrated barbells 16, and to serve as spotting means during exercise with weights. Further, the base 14 serves not only to support the frame 12, but also as a platform on which exercise can be performed and for supporting a conventional weight bench 18.

The frame 12 includes first and second oppositely disposed side portions 20 and 22, respectively, joined in substantially parallel alignment by one or more cross lintels 24. More specifically, the first side portion 20 includes the selectively spaced first and second vertical support members 26 and 28 joined at their upper end portions with the header member 30. The lower end portions of the support members 26 and 28 are secured to the base 14 with suitably securing means, such as the angle iron member 32 which has a vertical flange 34 which engages the support members 26 and 28, and a horizontal flange 36 which engages the base 14. Similarly, the second side portion 22 includes the selectively spaced first and second vertical support members 38 and 40, joined at their upper end portions with the further header member 42. Further, the lower end portions of the support members 38 and 40 are secured to the base 14 with suitable securing means, such as the further angle iron member 44 which has a vertical flange 46 for engaging the support members 38 and 40, and a horizontal flange 48 for engaging the base 14. It will be noted that the base 14 extends beyond the angle iron members 32 and 44 to ensure stability of the rack 10 when exercises are being performed.

It will be noted that in the preferred illustrated embodiment, the various components of the frame 12 are fabricated from angle iron, the L-shaped cross-section of the angle iron providing for great strength and durability. Moreover, the various components are secured together with a plurality of bolts 50 and cooperating nuts 52, such that the rack 10 can be easily disassembled and reassembled to facilitate transport and storage.

The weight lifting rack 10 further comprises weight support means which, in the preferred embodiment, includes at least two weight support pins 54. In this regard, each of the vertical support members 26, 28, 38 and 40 is provided with a plurality of selectively spaced holes 56 disposed along at least a portion of the length of the support member, with the holes 56 of the member 26 registering with the holes 56 of the member 28, and the holes 56 of the member 38 register with the holes 56 of the member 40. Thus, as illustrated, the pins 54 are slidably received by the registering holes 56 of the members 26 and 28, and the members 38 and 40, so as to extend between such support members in substantially horizontal alignment. Accordingly, the height of the pins 54 can be selected by preselection of the appropriate registering holes 56, with the pins 54 of the opposing side portions 20 and 22 preferably being set at substantially equal heights.

Figure 2:
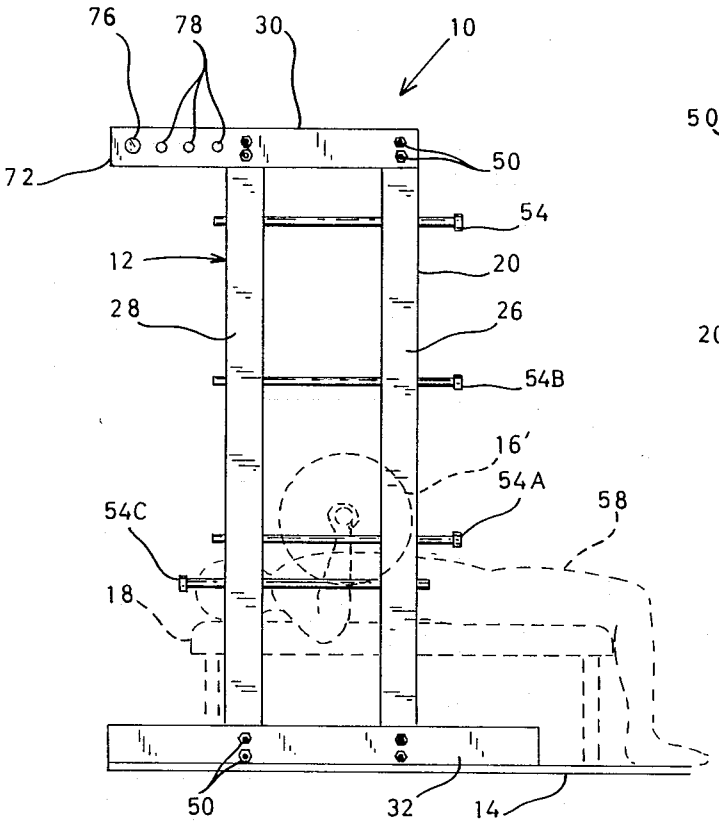
FIG. 2 illustrates a side elevation view of a weight lifting device of the present invention.

With the pins 54 positioned as described above, the pins 54 serve to support the weights 16 when at rest as illustrated in FIG. 1. Further, the pins 54 serve as a spotting means for allowing weight lifting exercises to be performed alone, thus obviating the need for a spotter to catch the weights should the lifter lose control of the weights or become tired. For example, as illustrated in FIG. 2, a pair of pins 54 can be set at the height referenced at 54A to serve as a spotting means while bench presses are being performed. At this height, the pins 54A are positioned just below range of motion of the weights 16 during performance of the particular exercise, but above the body of the lifter 58, such that should the lifter 58 lose control of the weights 16, the weights 16 will be caught by the pins 54A and the lifter will not be injured. Further, the support members 26, 28, 38 and 40 restrict forward and rearward travel of the weights 16. FIG. 2 also illustrates other possible pin placements. For example, the pin placement depicted at 54B generally illustrates the desired pin placement when exercises commonly known as "squats" are being performed, and the pin placement depicted at 54C generally illustrates the appropriate pin placement when exercises commonly known as "shoulder shrugs" are being performed. In each circumstance, the pins 54 are positioned immediately below the range of motion of the weight during exercise to catch the weight should control be lost. However, it will be recognized that a second pair of pins 54 can be positioned immediately above the upper range of motion of the weights during the exercise to restrict lateral tilting of the weights 16 should control be lost.

Figure 4:
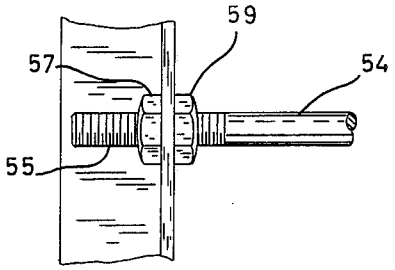
FIG. 4 illustrates a side elevation view of a portion of the rack of the present invention.

Referring now to FIG. 4, in the preferred embodiment the pins 54 define a free end portion 55 which is threaded to receive a locking nut 59 and an outer nut 57. As illustrated, the nuts 57 and 59 are threadably secured on either side of the operatively associated support member 26, 28, 38 or 40, and holds the pins 54 in a stationary position. Further, with the pins 54 thusly locked in place, the opposite end portions 61 of the pins extend beyond the frame 12 such that the end portions 61 can be used to support weights as illustrated at 16' of FIG. 2.

Referring once again to FIG. 1, in the preferred embodiment the rack 10 is also provided with a pull-down pulley assembly 60 for performing various pull-down weight lifting exercises. In the preferred illustrated embodiment, the pulley assembly 60 includes a brace member 62 which extends between the cross lintels 24, at the opposite ends of which are mounted first and second pullies 64 and 65, respectively. The pulleys 64 and 65 rotatably receive a cable 66 having a first end provided with a pull-down bar 68 and a second end provided with securing means 70 for engaging one or more weighs (not shown). Thus, exercise is performed by securing weights to the cable 66 and pulling down on the bar 68, thereby lifting the weights.

It will also be noted that in the preferred embodiment the header members 30 and 42 are provided with the extended portions 72 and 74, respectively, and the rack 10 includes a pull-up bar 76 which is supported by, and extends between, the extended portions 72 and 74. It will be recoqnized by those skilled in the art that the bar 76 is for performing exercises commonly known as "pull-ups" or "chin-ups". Further, it will be noted that in the preferred embodiment, the bar 76 is secured to the portions 72 and 74 by being releasably received through the holes 78 of the portions 72 and 74 such that the bar 76 can be easily removed when desired.

Figure 5:
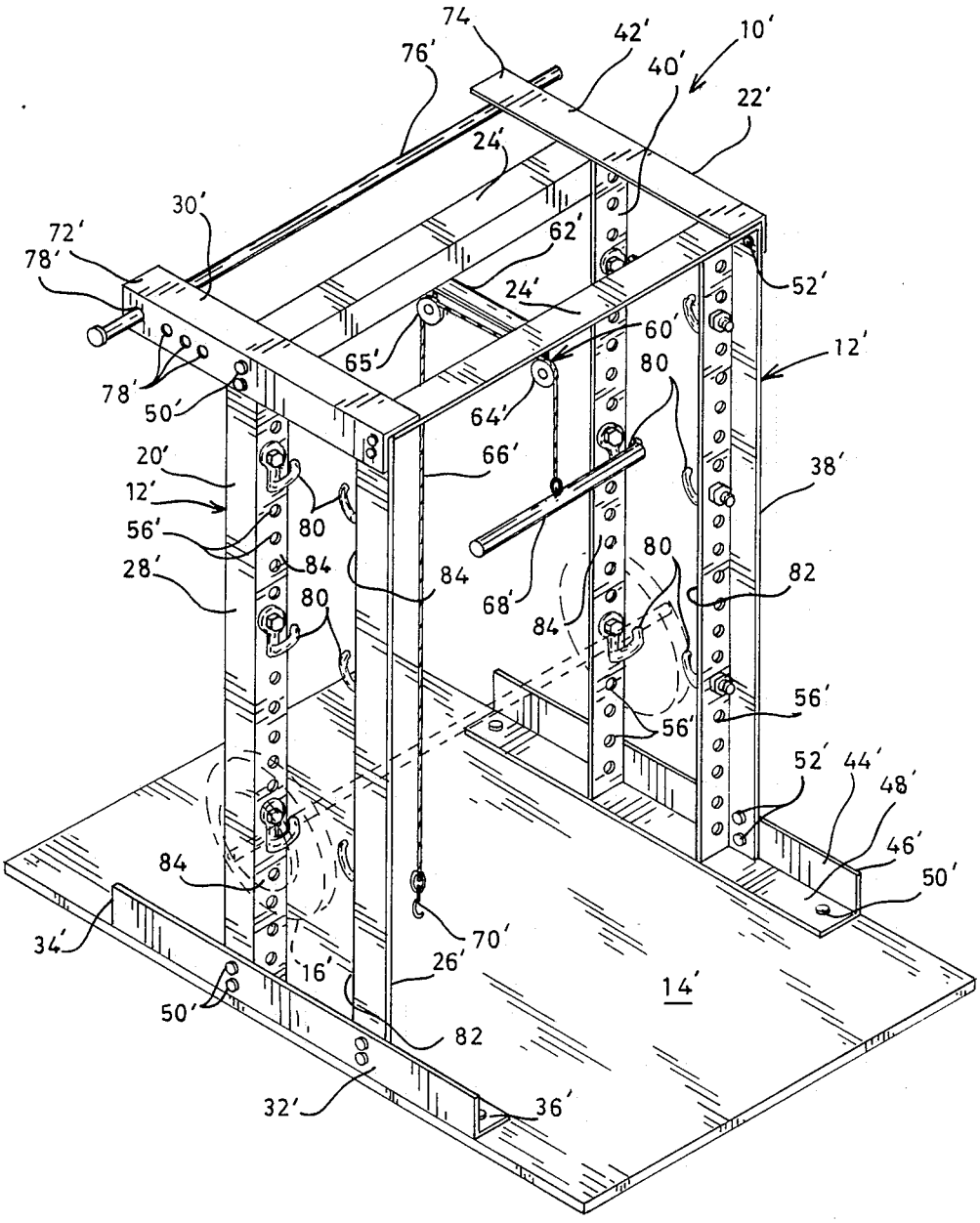
FIG. 5 illustrates a perspective view of an alternative embodiment of the weight lifting rack of the present invention.

In FIG. 5 an alternate embodiment of the weight lifting rack of the present invention is illustrated at 10'. For convenience, components of the rock 10' which are common to the above-described rack 10 will be referenced by common prime numerals. As illustrated the rack 10' is provided with a plurality of weight support hooks 80 for engaging and supporting the weights 16' rather than the weight support pins 54. More specifically, the hooks 80 are designed to be releasably mounted on the vertical support members 26' and/or 28' so as to be upwardly opening. In this regard the vertical support members 26' and 28' define the selectively spaced surfaces 82 and 84 on which the hooks 80 can be releasably mounted such that the upwardly disposed hooks 80 engage the weights 16' between the vertical support members 26' and 28'. Each of the side portions 20' and 22' is provided with at least one hook 80 such that the hooks of the selectively spaced side portions 20' and 22' cooperatively support the weight 16'. However, as illustrated in FIG. 5, each side portion 20' and 22' and each vertical support 26' and 28' of each such side portion can be provided with a plurality of hooks 80 in various positions as so to provide multiple supporting positions for the weights 16.

Figure 6:
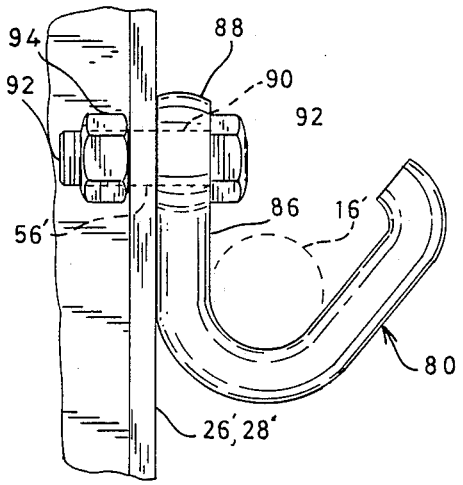
FIG. 6 illustrates a side elevation view of a weight support hook of the weight lifting rack of the present invention.

In the preferred embodiment each of the weight support hooks 80 have a shank portion 86 provided with an eyelet 88 having an opening 90 therethrough as illustrated in FIG. 6. In order to releasably secure the hook 80 to a vertical support 26' or 28' at the desired vertical position a bolt 92 is received through the opening 90 of the hook, and through one of the holes 56', and a nut 94 is threaded thereon. Thus, the hooks 80 can be releasably secured to the vertical supports at selected vertical position as may be necessary or desirable for specific weight lifting exercises. Of course, if during exercise the lifter should become tired or lose control of the weights the vertical supports 26' and 28' limit horizontal travel of the weights, and the hooks 80 are available to catch and support the weights.

Figure 7:
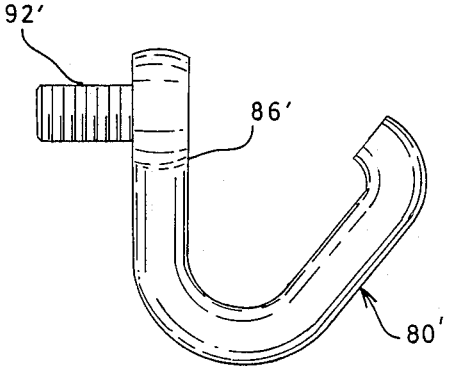
FIG. 7 illustrates a side elevation view of an alternate embodiment of the weight support hook of the present invention.

In FIG. 7 an alternate embodiment of the weight supporting hook of the present invention is illustrated at 80'. In this embodiment the bolt 92' is permanently secured to or integral with the shank portion 86' of the hook 80' so as to extend rearwardly therefrom. Accordingly, the hook 80' is mounted by inserting the bolt 92' through one of the holes 56' and threading a nut 94 thereon.

In light of the above, it will be appreciated that the present invention provides an improved weight lifting rack which allows weight lifting exercises to be safely performed without a spotter. Moreover, the base 14 provides a stable means for supporting the rack and a platform for performing weight lifting exercises.

While a preferred embodiment has been shown and described, it will be understood that there is no intent to limit the invention to such disclosure, but, rather, it is intended to cover all modifications and alternate constructions falling within the spirit and scope of the invention as defined in the appended claims.

I claim:

1. A demountable multi-function weight lifting rack for supporting barbell weights for performing weight lifting exercises and for facilitating the safe performance of said weight lifting exercises, said rack comprising:

a portable base defining a platform for performing said weight lifting exercises, said base further defining opposite side edges and opposite end portions;

a frame releasably mounted on, and supported by, said base, said frame including first and second selectively spaced side portions, each said side portion defining a lower end portion releasably secured to said base proximate said opposite side edges, and an upper end portion releasably secured to first and second cross lintels joining said first and second side portions, each said side portion further including first and second selectively spaced vertical support members, each said support member defining upper and lower end portions and being provided with a plurality of selectively spaced holes disposed along at least a portion of the length of said support member, said first and second support members of each of said side portions of said frame releasably joined at said upper end portions with a header, each of said headers having a cantilevered end portion extending in a common direction from said side portions of said frame, said cantilevered end portions provided with at least one transverse hole;

a pull-up bar having opposite end portions, said end portions engaged in said holes in said cantilevered end portions of said headers; and at least one upwardly opening weight support hook operatively associated with each side portion of said frame for releasably engaging and supporting said barbell weights, each said weight support hook being provided with a threaded bolt member for passing through said holes of said support members and a nut member threadably engaged with said bolt member for securing said hook to one said support member of said frame whereby at least one said hook is disposed between said first and second support members of each said side portion of said frame.

2. The weight lifting rack of claim 1 wherein said rack further comprises a pulley assembly, said pulley assembly joined to said first and second cross lintels, said pulley assembly provided with a pair of pulleys having a cable threaded therethrough, a pull bar attached to one end of said cable and a weight hook attached to a second end of said cable for engaging weights whereby pull-down exercises are performed.

3. The weight lifting rack of claim 1 wherein said end portions of said base extend from said frame in opposite directions to provide stability to said rack during said performing of weight lifting exercises.

4. A demountable multi-function weight lifting rack for supporting barbell weights for performing weight lifting exercises and for facilitating the safe performance of said weight lifting exercises, said rack comprising:

a portable base defining a platform for performing said weight lifting exercises, said base further defining opposite side edges and opposite end portions;

a frame releasably mounted on, and supported by, said base, said frame including first and second side portions, each said side portion defining a lower end portion releasably secured to said base proximate said opposite side edges and disposed from said opposite end portions of said base, and an upper end portion releasably secured to first and second cross lintels joining said first and second side portions, each said side portion further including first and second selectively spaced vertical support members, each said support member defining upper and lower end portions and being provided with a plurality of selectively spaced holes disposed along at least a portion of the length of said support member, said first and second support members of each of said side portions of said frame releasably jointed at said upper end portions with a header, each of said headers having a cantilevered end portion extending in a common direction from said side portions of said frame, said cantilevered end portions provided with at least one transverse hole;

a pull-up bar having opposite end portions, said end portions engaged in said holes in said cantilevered end portions of said headers;

a pulley assembly having a support bar joined to said first and second cross lintels, said pulley assembly provided with a pair of pulleys attached to said support bar having a cable threaded therethrough, said pulley further provided with a pull bar attached to one free end of said cable and with a weight engaging hook at a second free end of said cable; and a plurality of upwardly opening weight support hooks operatively associated with each of said side portion of said frame for releasably engaging and supporting said barbell weights, each said weight support hook being provided with a threaded bolt member for passing through selected of said holes of said support members and with a nut member threadably engaged with said bolt member for securing said hook to one said support member of said frame whereby said plurality of hooks are disposed between said first and second support members of each said side portion of said frame.

* * * * *